US009673552B2

(12) United States Patent
Tsai et al.

(10) Patent No.: US 9,673,552 B2
(45) Date of Patent: Jun. 6, 2017

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Ya-Fen Kao, New Taipei (TW); Dong Xiang, New Taipei (TW); Long-Fei Chen, New Taipei (TW)

(73) Assignee: ADVANCED-CONNECTEK INC., New Taipei (TW)

( * ) Notice: Subject to any disclaimer, the term of this patent is extended or adjusted under 35 U.S.C. 154(b) by 0 days.

(21) Appl. No.: 15/164,367

(22) Filed: May 25, 2016

(65) Prior Publication Data

US 2016/0352051 A1 Dec. 1, 2016

(30) Foreign Application Priority Data

May 28, 2015 (CN) ..... 2015 1 0279849

(51) Int. Cl.

| | |
|---|---|
| ***H01R 13/648*** | (2006.01) |
| ***H01R 13/405*** | (2006.01) |
| ***H01R 13/6585*** | (2011.01) |
| ***H01R 24/60*** | (2011.01) |
| *H01R 107/00* | (2006.01) |
| *H01R 24/78* | (2011.01) |
| *H01R 24/00* | (2011.01) |
| *H01R 43/24* | (2006.01) |

(52) U.S. Cl.

CPC ..... *H01R 13/405* (2013.01); *H01R 13/6585* (2013.01); *H01R 24/60* (2013.01); *H01R 23/02* (2013.01); *H01R 24/78* (2013.01); *H01R 43/24* (2013.01); *H01R 2107/00* (2013.01)

(58) Field of Classification Search

None

See application file for complete search history.

(56) References Cited

U.S. PATENT DOCUMENTS

| | | | | |
|---|---|---|---|---|
| 9,231,356 | B1 * | 1/2016 | Ju | H01R 24/78 |
| 2015/0244111 | A1 * | 8/2015 | Ju | H01R 13/6585 439/607.05 |
| 2016/0064868 | A1 * | 3/2016 | Little | H01R 13/6581 439/607.01 |

FOREIGN PATENT DOCUMENTS

| | | | |
|---|---|---|---|
| CN | 204216267 | U | 3/2015 |
| TW | 2010019548 | A | 5/2010 |
| TW | M499696 | U | 4/2015 |
| TW | M533349 | U | 12/2016 |

* cited by examiner

*Primary Examiner* — Tho D Ta

(74) *Attorney, Agent, or Firm* — Muncy, Geissler, Olds & Lowe, P.C.

(57) ABSTRACT

An electrical receptacle connector includes a metallic shell, an insulated housing, a plurality of first receptacle terminals, and a plurality of second receptacle terminals. The insulated housing is received in the receiving cavity. The insulated housing includes a tongue portion and a plurality of first through holes formed on the tongue portion. The first receptacle terminals are held in the tongue portion. The second receptacle terminals are held in the tongue portion. The second receptacle terminals include a plurality of cut portions corresponding to the first through holes.

19 Claims, 16 Drawing Sheets

100

| | | | | | | | | | | | | | | | | |
|---|---|---|---|---|---|---|---|---|---|---|---|---|---|---|---|---|
| GND | TX1+ | TX1− | VBUS | CC1 | D+ | D− | SBU1 | VBUS | RX2− | RX2+ | GND | 31 |
| GND | RX1+ | RX1− | VBUS | SBU2 | D− | D+ | CC2 | VBUS | TX2− | TX2+ | GND | 41 |

Fig. 6

ELECTRICAL RECEPTACLE CONNECTOR

CROSS-REFERENCES TO RELATED APPLICATIONS

This non-provisional application claims priority under 35 U.S.C. §119(a) on Patent Application No. 201510279849.1 filed in China, P.R.C. on 2015 May 28, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are totally different from those of a conventional USB electrical connector. A conventional USB type-C electrical receptacle connector includes a plastic core, upper and lower receptacle terminals held on the plastic core, and an outer iron shell circularly enclosing the plastic core. The lower-row receptacle terminals are formed at the bottom of the plastic core by insert-molding technique. The front of each of the lower receptacle terminals is bent upward and extending to a material band for the insert-molding.

SUMMARY OF THE INVENTION

However, when the front of each of the lower receptacle terminals is bent, the distance between each of the upper high-speed signal terminals and the corresponding lower high-speed signal terminal is quite small, and signal interference between the signal terminals may be generated easily.

Accordingly, how to improve the existing connector becomes an issue.

In view of this, an embodiment of the instant disclosure provides an electrical receptacle connector. The electrical receptacle connector comprises a metallic shell, an insulated housing, a plurality of first receptacle terminals, and a plurality of second receptacle terminals. The metallic shell comprises a shell body and a receiving cavity formed therein. The insulated housing is received in the receiving cavity. The insulated housing comprises a base portion, a tongue portion extending from one of two sides of the base portion, and a plurality of first through holes. The tongue portion has a first surface (i.e., upper surface) and a second surface (i.e., lower surface) opposite to the first surface. The first through holes are formed on the tongue portion. The first receptacle terminals comprise a plurality of first signal terminals, a plurality of power terminals, and a plurality of ground terminals. Each of the first receptacle terminals is held in the insulated housing and disposed at the first surface. Each of the first receptacle terminals comprises a flat contact portion, a body portion, and a tail portion. The body portion is held in the base portion and disposed at the first surface of the tongue portion. The flat contact portion is extending forward from the body portion in the rear-to-front direction and partly exposed upon the first surface of the tongue portion. The tail portion is extending backward from the body portion in the front-to-rear direction, and extending out of the base portion. The first signal terminals comprise a plurality of pairs of first high-speed signal terminals, each pair of the first high-speed signal terminals is between the corresponding power terminal and the adjacent ground terminal. The second receptacle terminals comprise a plurality of second signal terminals, a plurality of power terminals, and a plurality of ground terminals. Each of the second receptacle terminals is held in the insulated housing and disposed at the second surface. Each of the second receptacle terminals comprises a flat contact portion, a body portion, a tail portion, and a plurality of cut portions. The body is held in the base portion and disposed at the second surface of the tongue portion. The flat contact portion is extending forward from the body portion in the rear-to-front direction and partly exposed upon the second surface of the tongue portion. The tail portion is extending backward from the body portion in the front-to-rear direction and extending out of the base portion. The second signal terminals comprise a plurality of pairs of second high-speed signal terminals. Each pair of the second high-speed signal terminals is between the corresponding power terminal and the adjacent ground terminal. Each pair of the second high-speed signal terminals is adjacent to the corresponding pair of the first high-speed signal terminals. The cut portions are formed at the side portion of the flat contact portion of each of the second high-speed signal terminals, the side portion of the flat contact portion of each of the power terminals, and the side portion of the flat contact portion of each of the ground terminals. The cut portions respectively correspond to the first through holes.

In some embodiments, the electrical receptacle connector further comprises a plurality of filling members formed in the first through holes to cover the flat contact portion of each of the second high-speed signal terminals, the flat contact portion of each of the power terminals of the second receptacle terminal, and the flat contact portion of each of the ground terminals of the second receptacle terminal.

In some embodiments, the width of each of the first through holes equals to the distance between each of the power terminals of the second receptacle terminal and the adjacent ground terminal of the second receptacle terminal.

In some embodiments, each of the first through holes is defined through the tongue portion, from the first surface to the second surface.

In some embodiments, the first through holes are formed at two sides of the front of the tongue portion. The first through holes correspond to the flat contact portion of each of the second high-speed signal terminals, the flat contact portion of each of the power terminals of the second receptacle terminal, and the flat contact portion of each of the ground terminals of the second receptacle terminal.

In some embodiments, the insulated housing further comprises a second through hole formed at a middle portion of the rear of the tongue portion, and the second receptacle terminals further comprise a pair of low-speed signal terminals. The body portion of each of the lower-speed signal terminals correspond to the second through hole.

In some embodiments, the second receptacle terminals further comprise a plurality of extending portions. The extending portions are formed and extending between the side portion of the flat contact portion of each of the second high-speed signal terminals, the side portion of the flat contact portion of each of the power terminals, and the side portion of the flat contact portion of each of the ground terminals. The second receptacle terminals further comprise a plurality of cutting holes, the cutting holes are formed on the side portion of the flat contact portion of each of the second high-speed signal terminals, the side portion of the flat contact portion of each of the power terminals, and the side portion of the flat contact portion of each of the ground terminals, and the cutting holes are adjacent to each of the extending portions.

In some embodiments, the electrical receptacle connector further comprises a grounding plate at the insulated housing. The grounding plate comprises a plate body and a plurality of hooks. The plate body is between the flat contact portions of the first receptacle terminals and the flat contact portions of the second receptacle terminals. The hooks are extending from two sides of the front of the plate body and protruding out of a front lateral surface and two sides of the tongue portion.

In some embodiments, the first receptacle terminals and the second receptacle terminals have 180 degree symmetrical design with respect to a central point of the receiving cavity as the symmetrical center. The position of the flat contact portions of the first receptacle terminals corresponds to the position of the flat contact portions of the second receptacle terminals.

Based on the above, the first through holes formed on the tongue portion correspond to the extending portions between the second high-speed signal terminals, the power terminals, and the ground terminals of the second receptacle terminals. Pressing fixtures can be inserted into the first through holes to cut away the extending portions and form and remain the cut portions (i.e. cut surfaces). The extending portions between the second high-speed signal terminals, the power terminals, and the ground terminals of the second receptacle terminals allows the second receptacle terminals to be positioned so as to be assembled with the second portion properly. Accordingly, each pair of the first high-speed signal terminals is spaced from the corresponding pair of the second high-speed signal terminals by a uniform interval, and the signal interference problem between the first high-speed signal terminals and the second high-speed signal terminals can be prevented and improved. Hence, problems found in the conventional can be improved.

In addition, the manufacturing of the assembly of the insulated housing and the receptacle terminals has two times of insert-molding procedures, in a first time insert-molded procedure, the first receptacle terminals are integrated with the first portion, and the second receptacle terminals are integrated with the second portion. Next, in a second time insert-molded procedure, the filling members are formed in the first through holes to cover the body portion of each of the second high-speed signal terminals, the body portion of each of the power terminals, and the body portion of each of the ground terminals. The filling members are filled in the first through holes to separate each pair of the first high-speed signal terminals from the corresponding pair of the second high-speed signal terminals. As a result, the first high-speed signal terminals and the second high-speed signal terminals can be positioned properly. In addition, the filling members improves the structural strength of the tongue portion, and the filling members prevent the power terminals and the ground terminals exposed out of the first through holes from being connected electrically with each other. It is understood that when water moist is attached to the surfaces of the second receptacle terminals, short circuit problem may occur; in other words, the filling members can reduce the possibility of the short circuit problem.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims and drawings in the instant disclosure.

BRIEF DESCRIPTION OF THE DRAWINGS

The instant disclosure will become more fully understood from the detailed description given herein below for illustration only, and thus not limitative of the instant disclosure, wherein:

FIG. 6 illustrates a schematic configuration diagram of the receptacle terminals of the electrical receptacle connector shown in FIG. 5;

DETAILED DESCRIPTION

Figure 1:
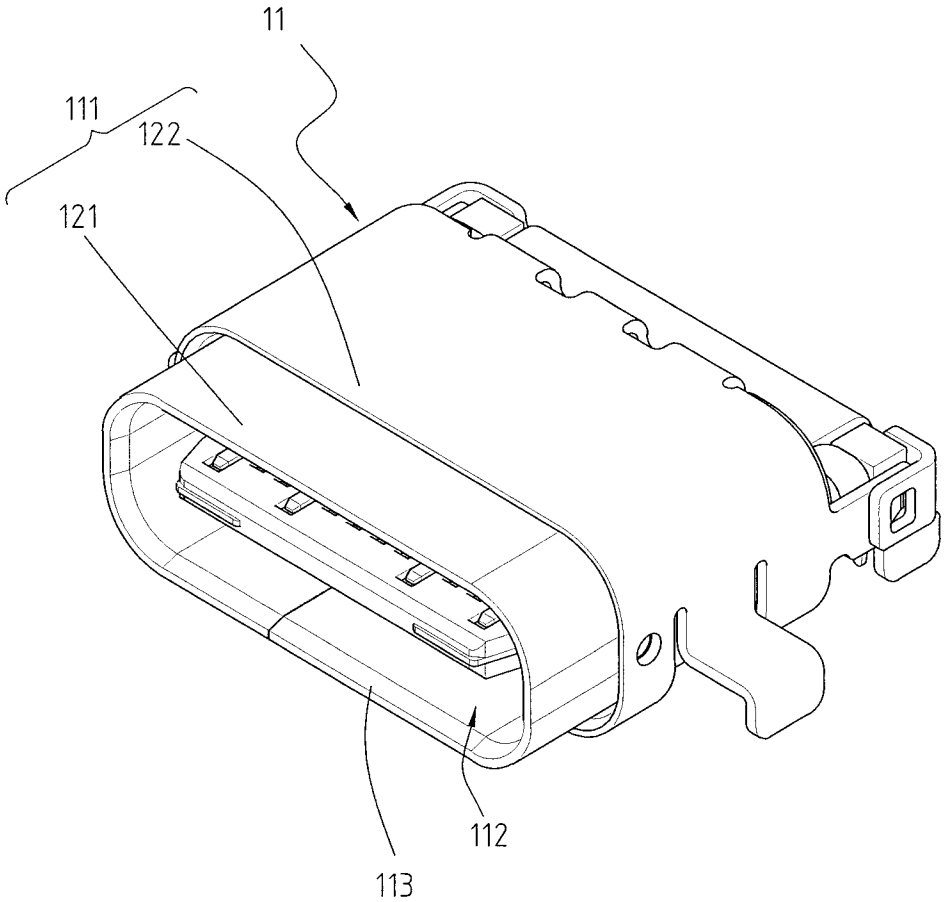
FIG. 1 illustrates a perspective view of an electrical receptacle connector according to a first embodiment of the instant disclosure.
Figure 2:
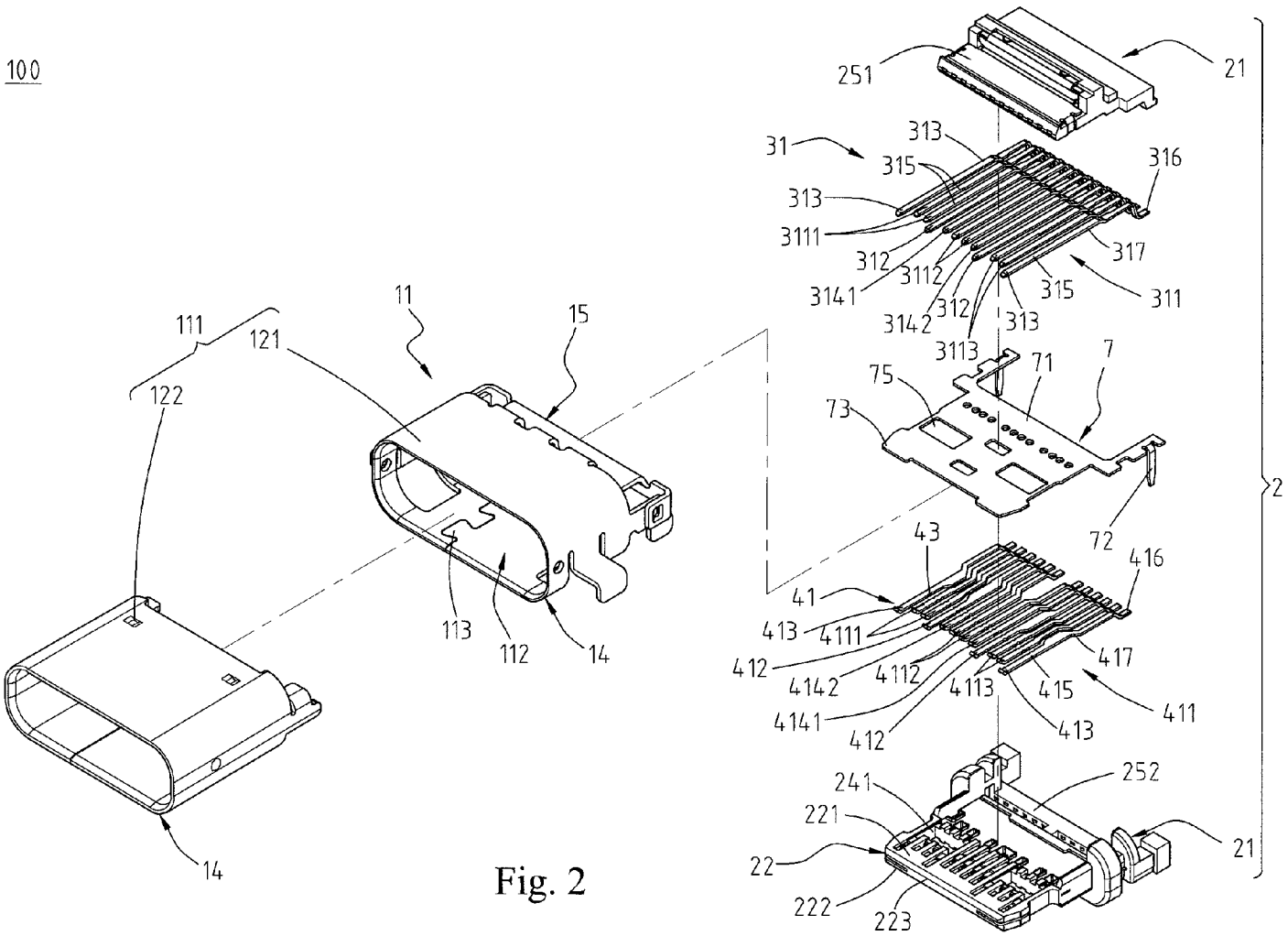
FIG. 2 illustrates an exploded view of the electrical receptacle connector of the first embodiment.
Figure 3:
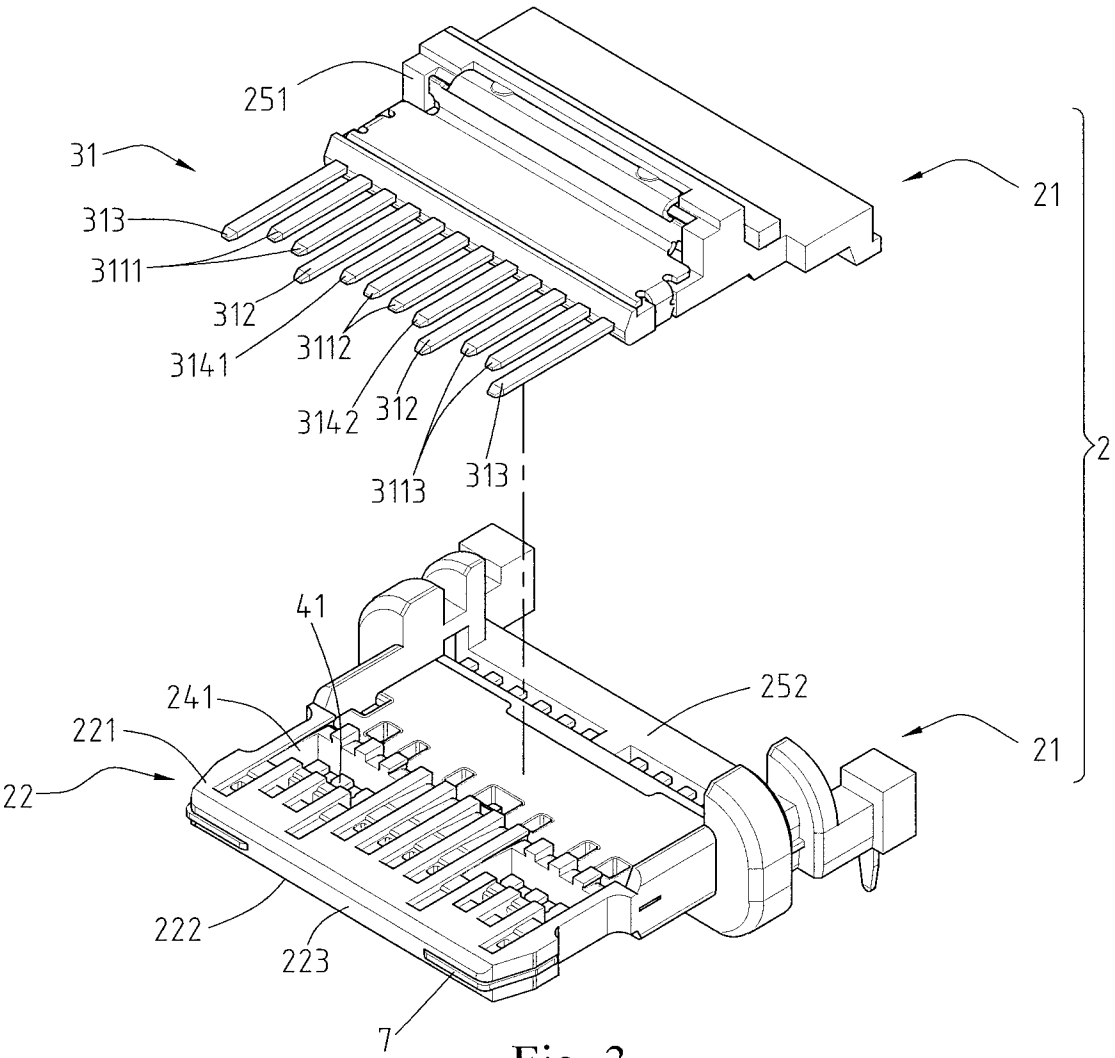
FIG. 3 illustrates a partial exploded view showing the assembly of first receptacle terminals and a first portion and the assembly of second receptacle terminals and a second portion.
Figure 4:
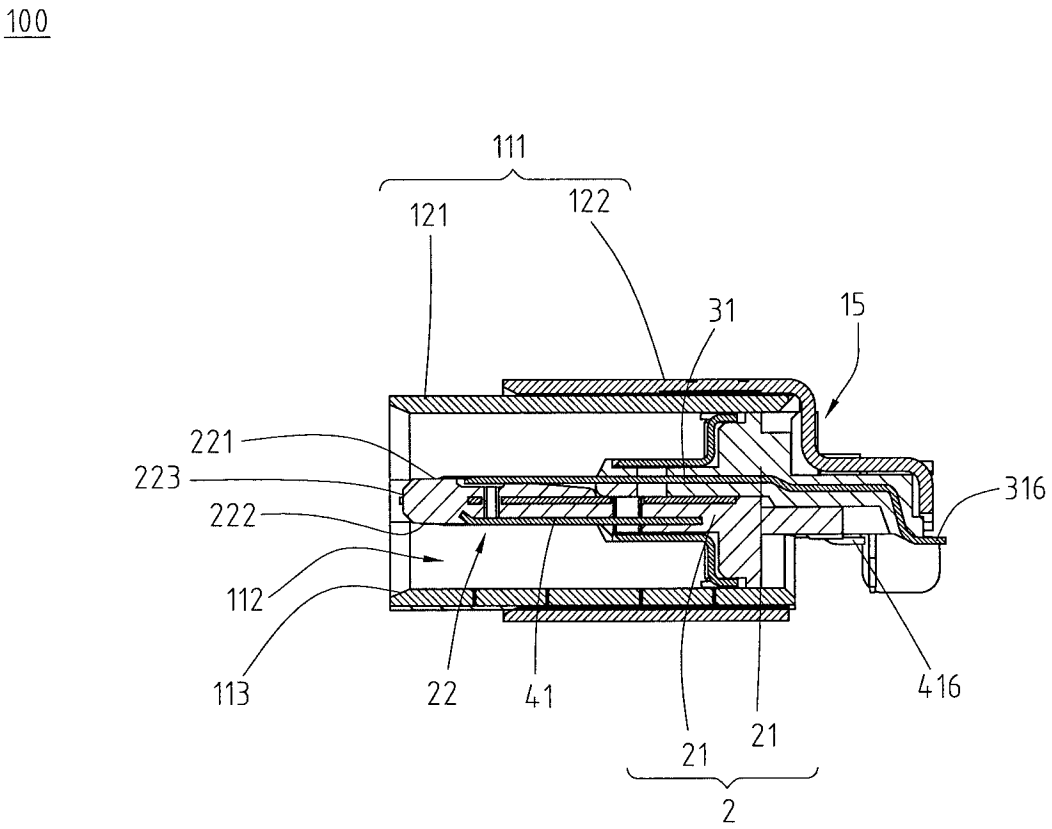
FIG. 4 illustrates a lateral sectional view of the electrical receptacle connector of the first embodiment.
Figure 5:
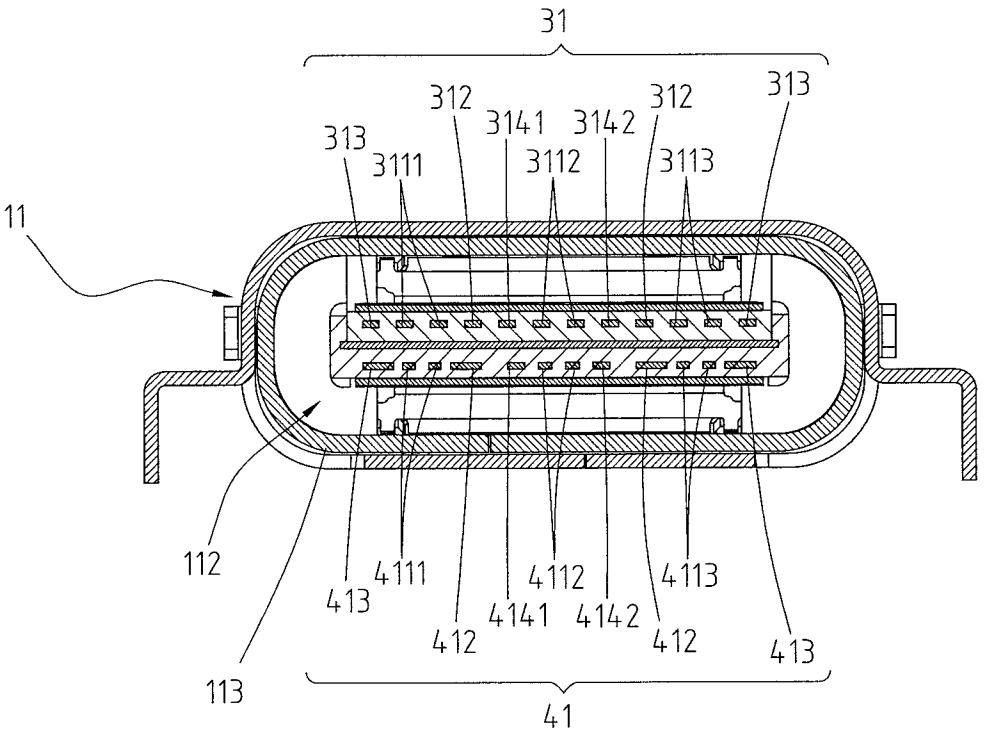
FIG. 5 illustrates a front sectional view of the electrical receptacle connector of the first embodiment.

Please refer to FIGS. 1 to 4, which illustrate an electrical receptacle connector 100 of a first embodiment of the instant disclosure. FIG. 1 illustrates a perspective view of an electrical receptacle connector 100. FIG. 2 illustrates an exploded view of the electrical receptacle connector 100. FIG. 3 illustrates a partial exploded view showing the assembly of first receptacle terminals 31 and a first portion 251 and the assembly of second receptacle terminals 41 and a second portion 252. FIG. 4 illustrates a lateral sectional view of the electrical receptacle connector 100. In this embodiment, the electrical receptacle connector 100 can provide a reversible or dual orientation USB Type-C connector interface and pin assignments, i.e., a USB Type-C receptacle connector. In this embodiment, the electrical receptacle connector 100 comprises a metallic shell 11, an insulated housing 2, a plurality of first receptacle terminals 31, a plurality of second receptacle terminals 41, and a plurality of filling members 5.

The metallic shell 11 is a hollowed shell, and the metallic shell 11 comprises a shell body 111 and a receiving cavity 112 formed in the shell body 111. In this embodiment, the shell body 111 is a tubular structure and defines the receiving cavity 112 therein. While in some embodiments, the metallic shell 11 may be formed by a multi-piece member; in such embodiments, the shell body 111 further comprises an inner shell 121 and a case 122. The inner shell 121 is a tubular structure 14 circularly enclosing the insulated housing 21. The case 122 may be a tubular structure 14 circularly enclosing the inner shell 121, but embodiments are not limited thereto. Alternatively, the case 122 may be a semi-tubular structure having a U-shaped cross section, and the case 122 can be covered on the top and two sides of the inner shell 121 and provided as an outer shell structure of the inner shell 121. A rear cover plate 15 is extending from the rear of the case 122, and the rear cover plate 15 is openable and closeable. In one embodiment, the rear cover plate 15 is at the rear of the inner shell 121 and the shell body 111 does not comprise the case 122. In addition, an inserting opening 113 with oblong shaped is formed at one side of the metallic shell 11, and the inserting opening 113 communicates with the receiving cavity 112.

The insulated housing 2 is received in the receiving cavity 112 of the metallic shell 11. The insulated housing 2 comprises a base portion 21, a tongue portion 22, and a plurality of first through holes 241. In this embodiment, the insulated housing 2 further comprises a first portion 251 and a second portion 252. The first portion 251 and the second portion 252 are assembled with each other. After the first portion 251 and the second portion 252 are assembled with each other, the assembly of the first portion 251 and the second portion 252 forms the base portion 21 and the tongue portion 22. The base portion 21, the tongue portion 22, and the first through holes 241 may be made by injection molding or the like to form the insulated housing 2, so that the base portion 21, the tongue portion 22, and the first through holes 241 are produced integrally as a whole. In addition, a grounding plate 7 is formed in the base portion 21 and the tongue portion 22. Moreover, the tongue portion 22 is extending from one of two sides of the base portion 21. The tongue portion 22 is in the front of the receiving cavity 112, while the base portion 21 is in the rear of the receiving cavity 112. The first through holes 241 are formed at two sides of the front of the tongue portion 22 and adjacent to the insertion opening 113. In other words, the first through holes 241 are formed at the two sides of the front of the tongue portion 22, adjacent to the front lateral surface 223 but spaced from the front lateral surface 223, but embodiments are not limited thereto. In some embodiments, the first through holes 241 are formed at two sides of the rear of the tongue portion 22 and distant from the insertion opening 113. In addition, the tongue portion 22 has two opposite surfaces, one is a first surface 221 (i.e., the upper surface), and the other is a second surface 222 (i.e., the lower surface). In addition, the front lateral surface 223 of the tongue portion 22 is connected the first surface 221 with the second surface 222 and is close to the insertion opening 113. In other words, the front lateral surface 223 is adjacent to the insertion opening 113 and perpendicularly connected to the first surface 221 and the second surface 222, respectively.

Please refer to FIGS. 2, 4, and 6. The first receptacle terminals 31 comprise a plurality of first signal terminals 311, a plurality of power terminals 312, and a plurality of ground terminals 313. The first signal terminals 31 comprises a plurality of pairs of first high-speed signal terminals 3111/3113 and a pair of first low-speed signal terminals 3112. Referring to FIG. 6, the first receptacle terminals 31 comprise, from left to right, a ground terminal 313 (Gnd), a first pair of first high-speed signal terminals 3111 (TX1+−, differential signal terminals for high-speed signal transmission), a power terminal 312 (Power/VBUS), a first function detection terminal 3141 (CC1, a terminal for inserting orientation detection of the connector and for cable recognition), a pair of first low-speed signal terminals 3112 (D+−, differential signal terminals for low-speed signal transmission), a supplement terminal 3142 (SBU1, a terminal can be reserved for other purposes), another power terminal 312 (Power/VBUS), a second pair of first high-speed signal terminals 3113 (RX2+−, differential signal terminals for high-speed signal transmission), and another ground terminal 313 (Gnd). In this embodiment, twelve first receptacle terminals 31 are provided for transmitting USB 3.0 signals. Each pair of the first high-speed signal terminals 3111/3113 is between the corresponding power terminal 312 and the adjacent ground terminal 313. The pair of the first low-speed signal terminals 3112 is between the first function detection terminal 3141 and the supplement terminal 3142.

In some embodiments, the rightmost ground terminal 313 (Gnd) (or the leftmost ground terminal 313 (Gnd)) or the first supplement terminal 3142 (SBU1) can be further omitted. Therefore, the total number of the first receptacle terminals 31 can be reduced from twelve terminals to seven terminals. Furthermore, the rightmost ground terminal 313 (Gnd) may be replaced by a power terminal 312 (Power/VBUS) and provided for power transmission. In this embodiment, the width of the power terminal 312 (Power/VBUS) may be, but not limited to, equal to the width of the first signal terminal 311. In some embodiments, the width of the power terminal 312 (Power/VBUS) may be greater than the width of the first signal terminal 311 and an electrical receptacle connector 100 having the power terminal 312 (Power/VBUS) can be provided for large current transmission.

Please refer to FIGS. 2, 4, and 6. The first receptacle terminals 31 are held in the base portion 21 and the tongue portion 22 and formed as the upper-row terminals of the electrical receptacle connector 100. Each of the first receptacle terminals 31 comprises a flat contact portion 315, a body portion 317, and a tail portion 316. For each of the first receptacle terminals 31, the body portion 317 is held in the base portion 21 and the tongue portion 22, the flat contact portion 315 is extending forward from the body portion 317 in the rear-to-front direction and partly exposed upon the first surface 221 of the tongue portion 22, and the tail portion 316 is extending backward from the body portion 317 in the front-to-rear direction and protruded from the base portion 21. The first signal terminals 311 are disposed at the first surface 221 and transmit first signals (namely, USB 3.0 signals). The tail portions 316 are protruded from the bottom of the base portion 21. In addition, the tail portions 316 may be, but not limited to, bent horizontally to form flat legs, named SMT (surface mounted technology) legs, which can be mounted or soldered on the surface of a printed circuit board by using surface mount technology. In some embodiments, the tail portions 316 are extending downwardly to form vertical legs, named through-hole legs, that are inserted into holes drilled in a printed circuit board by using through-hole technology.

Please refer to FIGS. 2, 4, and 6. The second receptacle terminals 41 comprise a plurality of second signal terminals 411, a plurality of power terminals 412, and a plurality of ground terminals 413. The second receptacle terminals 41 comprise a plurality of pairs of second high-speed signal terminals 4111/4113 and a pair of second low-speed signal terminals 4112. Referring to FIG. 6, the second receptacle terminals 41 comprise, from right to left, a ground terminal 413 (Gnd), a first pair of second high-speed signal terminals 4111 (TX2+−, differential signal terminals for high-speed signal transmission), a power terminal 412 (Power/VBUS), a second function detection terminal 4141 (CC2, a terminal for inserting orientation detection of the connector and for cable recognition), a pair of second low-speed signal terminals 4112 (D+−, differential signal terminals for low-speed signal transmission), a supplement terminal 4142 (SBU2, a terminal can be reserved for other purposes), another power terminals 412 (Power/VBUS), a second pair of second high-speed signal terminals 4113 (RX1+−, differential signal terminals for high-speed signal transmission), and another ground terminal 413 (Gnd). In this embodiment, twelve second receptacle terminals 41 are provided for transmitting USB 3.0 signals. Each pair of the second high-speed signal terminals 4111/4113 is between the corresponding power terminal 412 and the adjacent ground terminal 413. The pair of the second low-speed signal terminals 4112 is between the second function detection terminal 4141 and the supplement terminal 4142

In some embodiments, the rightmost ground terminal 413 (or the leftmost ground terminal 413) or the second supplement terminal 4142 (SBU2) can be further omitted. Therefore, the total number of the second receptacle terminals 41 can be reduced from twelve terminals to seven terminals. Furthermore, the rightmost ground terminal 413 may be replaced by a power terminal 412 and provided for power transmission. In this embodiment, the width of the power terminal 412 (Power/VBUS) may be, but not limited to, equal to the width of the second signal terminal 411. In some embodiments, the width of the power terminal 412 (Power/VBUS) may be greater than the width of the second signal terminal 411 and an electrical receptacle connector 100 having the power terminal 412 (Power/VBUS) can be provided for large current transmission.

Please refer to FIGS. 2, 4, and 6. The second receptacle terminals 41 are held in the base portion 21 and the tongue portion 22 and formed as the lower-row terminals of the electrical receptacle connector 100. The length of each of the first receptacle terminals 31 is greater than that of the corresponding second receptacle terminal 41; that is, the exposed length of each of the first receptacle terminals 31 is greater than that of the corresponding second receptacle terminal 41. Each of the second receptacle terminals 41 comprises a flat contact portion 415, a body portion 417, a tail portion 416, and a plurality of cut portions 43. For each of the second receptacle terminals 41, the body portion 417 is held in the base portion 21 and the tongue portion 22, the flat contact portion 415 is extending from the body portion 417 in the rear-to-front direction and partly exposed upon the second surface 222 of the tongue portion 22, and the tail portion 416 is extending backward from the body portion 417 in the front-to-rear direction and protruded from the base portion 21. The second signal terminals 411 are disposed at the second surface 222 and provided for transmitting second signals (i.e., USB 3.0 signals). The tail portions 416 are protruded from the bottom of the base portion 21. In addition, the tail portions 416 may be, but not limited to, bent horizontally to form flat legs, named SMT legs, which can be mounted or soldered on the surface of a printed circuit board by using surface mount technology.

Please refer to FIGS. 2, 4, and 6. In this embodiment, the first receptacle terminals 31 and the second receptacle terminals 41 are respectively disposed at the first surface 221 and the second surface 222 of the tongue portion 22. Each pair of the first high-speed signal terminals 3111/3113 is spaced from the corresponding pair of the second high-speed signal terminals 4111/4113 by a uniform interval. Therefore, the signal interference between the first high-speed signal terminals 3111/3113 and the second high-speed signal terminals 4111/4113 can be prevented.

Please refer to FIGS. 2, 4, and 6. Pin-assignments of the first receptacle terminals 31 and the second receptacle terminals 41 are point-symmetrical with a central point of the receiving cavity 112 as the symmetrical center. In other words, pin-assignments of the first receptacle terminals 31 and the second receptacle terminals 41 have 180 degree symmetrical design with respect to the central point of the receiving cavity 112 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 31 (or the second receptacle terminals 41), are rotated by 180 degrees with the symmetrical center as the rotating center, the first receptacle terminals 31 and the second receptacle terminals 41 are overlapped. That is, the rotated first receptacle terminals 31 are arranged at the position of the original second receptacle terminals 41, and the rotated second receptacle terminals 41 are arranged at the position of the original first receptacle terminals 31. In other words, the first receptacle terminals 31 and the second receptacle terminals 41 are arranged upside down, and the pin assignments of the flat contact portions 315 are left-right reversal with respect to that of the flat contact portions 415. An electrical plug connector is inserted into the electrical receptacle connector 100 with a first orientation where the first surface 221 is facing up, for transmitting first signals. Conversely, the electrical plug connector is inserted into the electrical receptacle connector 100 with a second orientation where the first surface 221 is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 31 (or the second receptacle terminals 41) when an electrical plug connector to be mated with the electrical receptacle connector 100 has upper and lower plug terminals. In the case that the first receptacle terminals 31 are omitted, the upper plug terminals or the lower plug terminals of the electrical plug connector are in contact with the second receptacle terminals 41 of the electrical receptacle connector 100 when the electrical plug connector is inserted into the electrical receptacle connector 100 with the dual orientations. Conversely, in the case that the second receptacle terminals 41 are omitted, the upper plug terminals or the lower plug terminals of the electrical plug connector are in contact with the first receptacle terminals 31 of the electrical receptacle connector 100 when the electrical plug connector is inserted into the electrical receptacle connector 100 with the dual orientations.

Please refer to FIGS. 2, 4, and 6. In this embodiment, the tail portions 316, 416 are protruded from the base portion 211 and arranged separately. The tail portions 316, 416 may be arranged into two parallel rows. Alternatively, the tail portions 416 may be aligned into two rows and the first row of the tail portions 416 is aligned by an offset with respect to the second row of the tail portions 416; thus, the tail portions 316, 416 form three rows.

Please refer to FIGS. 2, 4, and 6. In this embodiment, as viewed from the front of the receptacle terminals 31, 41, the position of the first receptacle terminals 31 corresponds to the position of the second receptacle terminals 41. In other words, the position of the flat contact portions 315 correspond to the position of the flat contact portions 415, but embodiments are not limited thereto. In some embodiments, the first receptacle terminals 31 may be aligned by an offset with respect to the second receptacle terminals 41. That is, the flat contact portions 315 are aligned by an offset with respect to the flat contact portions 415. Accordingly, because of the offset alignment of the receptacle terminals 31, 41, the crosstalk between the first receptacle terminals 31 and the second receptacle terminals 41 can be reduced during signal transmission. It is understood that, when the receptacle terminals 31, 41 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 31, 41 of the electrical receptacle connector 100 for power or signal transmission.

In the foregoing embodiments, the receptacle terminals 31, 41 are provided for transmitting USB 3.0 signals, but embodiments are not limited thereto. In some embodiments, for the first receptacle terminals 31 in accordance with transmission of USB 2.0 signals, the first pair of the first high-speed signal terminals 3111 (TX1+−) and the second pair of the first high-speed signal terminals 3113 (RX2+−) are omitted, and the pair of the first low-speed signal terminals 3112 (D+−) and the power terminals 312 (Power/VBUS) are retained. While for the second receptacle terminals 41 in accordance with transmission of USB 2.0 signals, the first pair of the second high-speed signal terminals 4111 (TX2+−) and the second pair of the second high-speed signal terminals 4113 (RX1+−) are omitted, and the pair of the second low-speed signal terminals 4112 (D+−) and the power terminals 412 (Power/VBUS) are retained.

Figure 7:
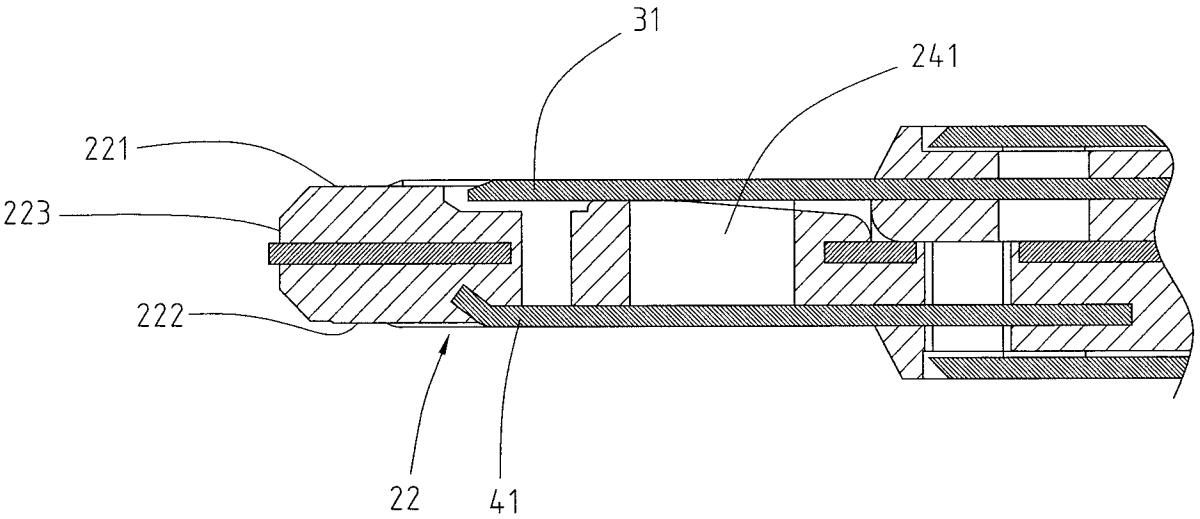
FIG. 7 illustrates a partials lateral sectional view of the electrical receptacle connector of the first embodiment.
Figure 8:
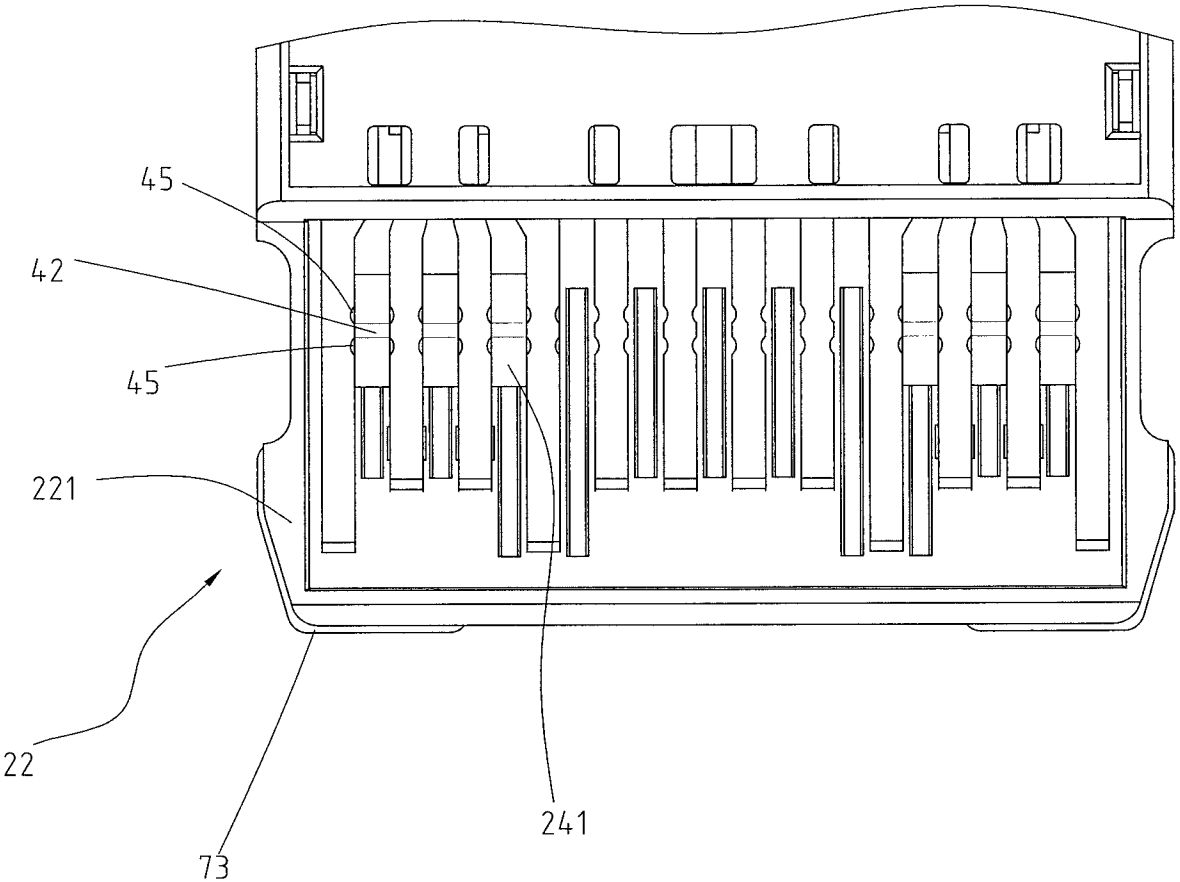
FIG. 8 illustrates a top view of the electrical receptacle connector of the first embodiment with extending portions.

Please refer to FIGS. 7 and 8. The side portion of the flat contact portion 415 of each of the second high-speed signal terminals 4111/4113, the side portion of the flat contact portion 415 of each of the power terminals 412, and the side portion of the flat contact portion 415 of each of the ground terminals 413 are integrated with each other by several extending portions 42. The position of the extending portions 42 corresponds to the position of the first through holes. Because some of the second receptacle terminals 41 are integrated with each other by the extending portions 42, the structural strengths of the second receptacle terminals 41 can be improved. Specifically, because of the extending portions 42, the flat contact portions 415 and the body portions 417 would not be shifted or bent downward by the gravity force. In other words, the flat contact portions 415 of some of the second receptacle terminals 41 are integrated with each other via the extending portions 42, and the second receptacle terminals 41 are integrated to form a unitary piece. Therefore, before the second receptacle terminals 41 are formed with the insulated housing 2, the flat contact portions 415 would not be bent downward by the gravity force because of the improved structural strength of the flat contact portions 415. Consequently, the distance between each pair of the second high-speed signal terminals 4111/4113 and the corresponding pair of the first high-speed signal terminal 3111/3113 can be maintained properly, and the signal interference between the first high-speed signal terminals 3111/3113 and the second high-speed signal terminals 4111/4113 can be reduced. In other words, before the second receptacle terminals 41 are formed with the insulated housing 2, some of the second receptacle terminals 41 are integrated with each other via the extending portions 42. Therefore, the structural strength of the flat contact portions 415 of the second receptacle terminals 41 can be improved, and the flat contact portions 415 would not be bent downward by the gravity force. In addition, because the second receptacle terminals 41 are connected with each other via the extending portions 42, the flat contact portions 415 can be positioned properly during the insert-molding procedure.

Please refer to FIGS. 3, 7, and 8. In this embodiment, the first receptacle terminals 31 are insert-molded with the first portion 251, and the second receptacle terminals 41 are insert-molded with the second portion 252. The side portion of the flat contact portion 415 of each of the second high-speed signal terminals 4111/4113, the side portion of the flat contact portion 415 of each of the adjacent power terminals 412, and the side portion of the flat contact portion 415 of each of the adjacent ground terminal 413 are integrated as one piece via the extending portions 42. The first through holes 241 are formed at two sides of the front of the second portion 252. The formation of the first through hole 241 is described as below. In the insert molding procedure, the insulated housing 2 is received in a mold having a plurality of processing fixtures. After the insulated housing 2 is molded, the two sides of the front of the second portion 252 form the first through holes 241.

Figure 9:
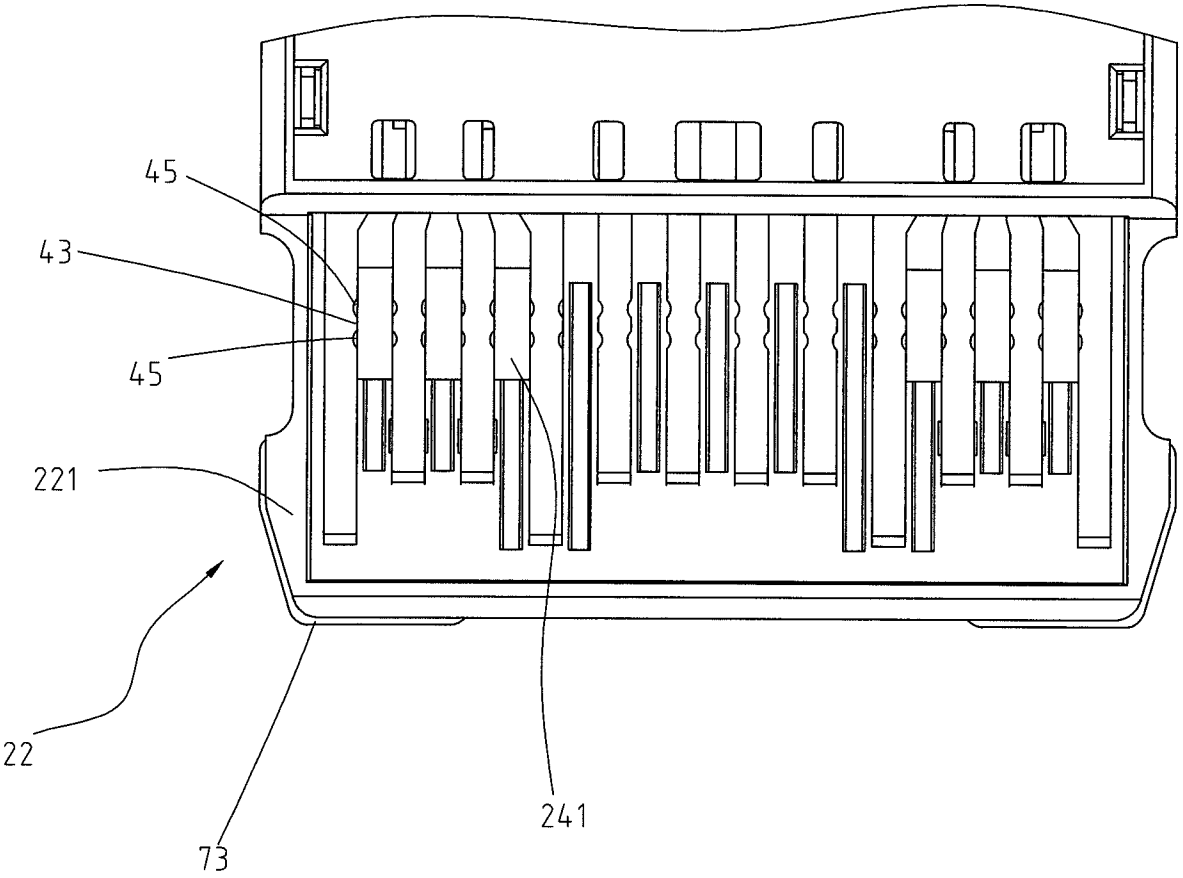
FIG. 9 illustrates a top view of the electrical receptacle connector of the first embodiment in which the extending portions are cut to form the cut portions.

Please refer to FIGS. 8 and 9. In this embodiment, the second receptacle terminals comprise a plurality of cut portions 43 which are formed by cut away the extending portions through the first through holes 241. Because the cut portions 43 correspond to the first through holes 241 and the extending portion 42 are exposed in the first through holes 241, pressing fixtures can be inserted into the first through holes 241 to cut away the extending portion 42 (i.e., to break the extending portions 42) to remain the cut portion 43. Therefore, the second high-speed signal terminals 4111/4113, the power terminals 412, and the ground terminals 413 can be separated from each other by breaking the extending portions 42. Accordingly, the second receptacle terminals 41 can be manufactured in the insulated housing 2 conveniently.

Figure 13:
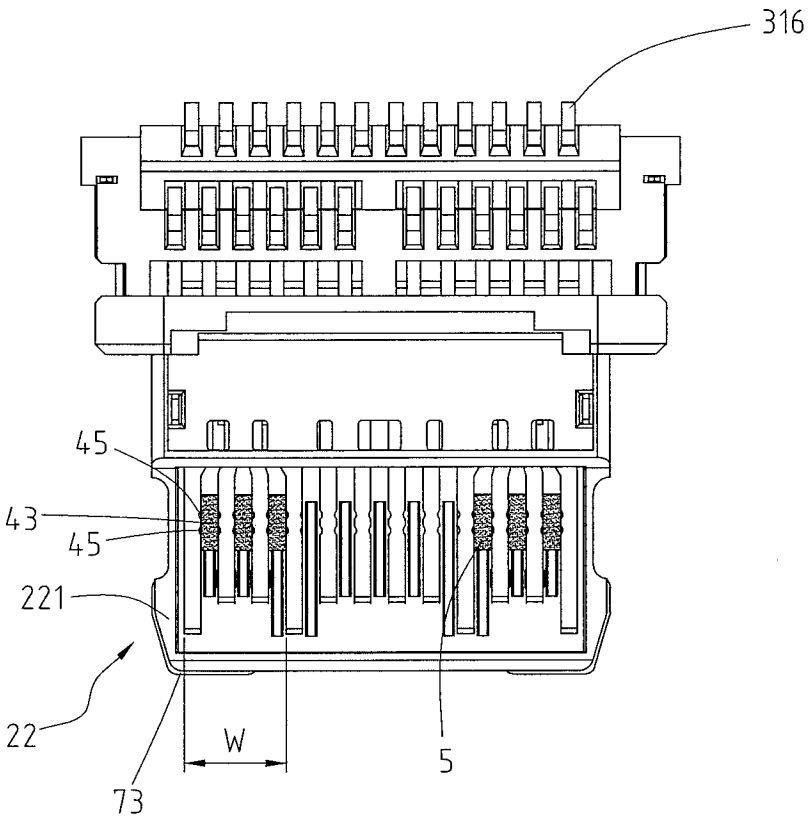
FIG. 13 illustrates a top schematic view of the electrical receptacle connector having a filling member filled in the first through holes.

Please refer to FIGS. 8, 9, and 13. In this embodiment, in a first time insert-molded procedure, the first receptacle terminals 31 are integrated with the first portion 251, and the second receptacle terminals 41 are integrated with the second portion 252. Then, the first portion 251 is assembled with the second portion 252, and the extending portions 42 are cut. Next, in a second time insert-molded procedure, the filling members 5 are formed in the first through holes 241 to cover the body portion 417 of each of the second high-speed signal terminals 4111/4113, the body portion 417 of each of the power terminals 412, and the body portion 417 of each of the ground terminals 413. The filling members 5 are filled in the first through holes 241 to separate each pair of the first high-speed signal terminals 3111/3113 from the corresponding pair of the second high-speed signal terminals 4111/4113. As a result, the first high-speed signal terminals 3111/3113 and the second high-speed signal terminals 4111/4113 can be positioned properly. In addition, the filling members 5 improves the structural strength of the tongue portion 22, and the filling members 5 prevent the power terminals 412 and the ground terminals 413 exposed out of the first through holes 241 from being connected electrically with each other. It is understood that when water moist is attached to the surfaces of the second receptacle terminals 41, short circuit problem may occur; in other words, the filling members 5 can reduce the possibility of the short circuit problem. Moreover, the filling members 5 and the insulated housing 2 may be made by the same plastic material.

In addition, the first through holes may be defined through the second portion 252. In such case, several pressing fixtures are respectively extending toward the top and the bottom of the extending portions 42 to cut away the extending portion 42 to remain the cut portions 43, but embodiments are not limited thereto. In some embodiments, the first through holes 241 may be not defined through the second portion 252; i.e., the first through holes 241 may be recessed from the first surface 221 or the second surface 222 of the tongue portion 22 of the second portion 252, and a single set of pressing fixtures is extending toward the top or the bottom of the extending portions 42 to cut away the extending portion 42 to remain the cut portions 43.

Figure 10:
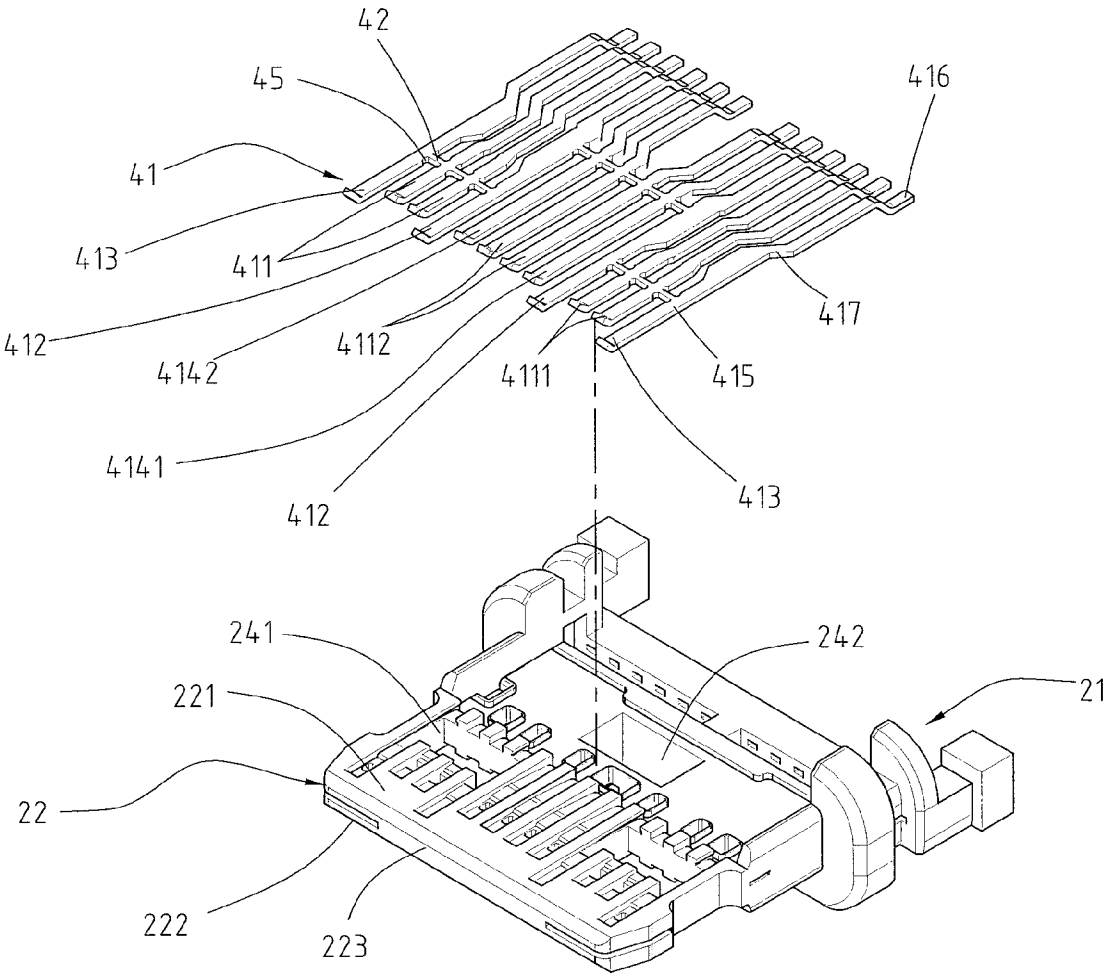
FIG. 10 illustrates an exploded view of an electrical receptacle connector according to a second embodiment of the instant disclosure.

Please refer to FIGS. 10 and 13. Front the front view of the tongue portion 22, the width W of each of the first through holes 241 equals to the distance between each of the power terminals 412 and the adjacent ground terminal 413. In other words, the distance between two opposite inner walls of each of the first through holes 241 is approximately the summation of the width of the flat contact portion 415 of one power terminal 412, the widths of the flat contact portions 415 of one pair of second high-speed signal terminals 4111/4113, and the width of the flat contact portion 415 of one ground terminal 413. After the filling members 5 are formed and filled in the first through holes 241, the filling members 5 cover the side portions of the flat contact portions 415 of the second high-speed signal terminals 4111/4113, the side portions of the flat contact portions 415 of the power terminals 412, and the side portions of the flat contact portions 415 of the ground terminals 413, and the filling members 5 are aligned with the side surfaces of the flat contact portions 415. Consequently, the structural strength of the body portions 417 and the tongue portion 22 can be improved.

Please refer to FIGS. 8 and 9. In this embodiment, the second receptacle terminals 41 comprise a plurality of cutting holes 45. The cutting holes 45 are formed on the side portion of the flat contact portion 415 of each of the second high-speed signal terminals 4111/4113, the side portion of the flat contact portion 415 of each of the power terminals 412, and the side portion of the flat contact portion 415 of each of the ground terminals 413. The cutting holes 45 are adjacent to each of the extending portions 42. When a pressing fixture is applied to cut the extending portions 42, the cutting holes 45 are provided as reference marks for breaking the extending portions 42 from the second receptacle terminals 41 uniformly. In other words, when the second receptacle terminals 41 do not comprise the cutting holes 45, the side portions of the flat contact portions 415 of the second receptacle terminals may be broken unintentionally during the operation of the pressing fixture. That is, the cutting holes allow the extending portions 42 to be removed from the second receptacle terminals 41 by the pressing fixture precisely.

The second receptacle terminals 41 further comprise a terminal fixing portion (i.e., a strip or belting) extending from end portions of the tail portions 416. The second receptacle terminals are integrated with each other by the terminal fixing portion. During the insert-molding procedure of the insulated housing 2 and the second receptacle terminals 41, the second receptacle terminals 41 are positioned by the terminal fixing portion, so that the second receptacle terminals 41 can be processed in the mold. After the insert-molded procedure, the second receptacle terminals 41 are assembled with the insulated housing 2, and the terminal fixing portion is cut by the pressing fixtures.

Please refer to FIGS. 2, 4, 5, and 7. In some embodiments, the electrical receptacle connector 100 further comprises a grounding plate 7 at the insulated housing 2. The grounding plate 7 comprises a plate body 71, a plurality of legs 72, a plurality of hooks 73, and a plurality of holes 75. The plate body 71 is between the flat contact portions 315 of the first receptacle terminals 31 and the flat contact portions 415 of the second receptacle terminals 41. In other words, the plate body 71 is held in the base portion 21 and the tongue portion 22 and between the flat contact portions 315 and the flat contact portions 415. In addition, the legs 72 are respectively extending downward from two sides of the plate body 71 and extending out of the bottom of the base portion 21. The legs 72 are in contact with contacts of a circuit board. Moreover, the legs 72 may be extending backward from the two sides of the plate body 71 toward the rear of the base portion 21, and the legs 72 are in contact with the rear cover plate 15. The crosstalk interference can be reduced by the shielding of the grounding plate 7 when the flat contact portions 315, 415 transmit signals. Furthermore, the structural strength of the tongue portion 22 can be improved by the assembly of the grounding plate 7. Moreover, the legs 72 extending downward from the two sides of the plate body 71 may be provided as through-hole legs, and the legs 72 are exposed from the base portion 21 to be in contact with the circuit board.

Furthermore, as shown in FIG. 8, the hooks 73 are extending from two sides of the front of the plate body 71 and protruded out of the front lateral surface 223 and two sides of the tongue portion 22. When an electrical plug connector is mated with the electrical receptacle connector 100, elastic pieces at two sides of an insulated housing of the electrical plug connector are engaged with the hooks 73, and the elastic pieces would not wear against the tongue portion 22 of the electrical receptacle connector 100. Additionally, the electrical plug connector may further comprise a plurality of protruded abutting portions, and the protruded abutting portions are in contact with the metallic shell 11 of the electrical receptacle connector 100. Hence, the elastic pieces and the protruded abutting portions are provided for conduction and grounding.

Please refer to FIG. 2. In addition, the holes 75 are formed on the plate body 71 of the grounding plate 7, and the location of the holes 75 corresponds to the location of the first through holes 241. When the second receptacle terminals 41 are insert-molded with the second portion 252, the grounding plate 7 may be integrated with the second portion 252 at the same time. When a pressing fixture is inserted into the first through hole 241 to press and cut the extending portion 42, the pressing fixture may be also inserted into the hole 75 of the plate body 71. Therefore, when pressing fixtures are applied to remove the extending portions 42, the pressing fixtures can be also inserted into the holes 75 of the plate body 71 to press and cut the extending portions 42. In other words, because the plate body 71 comprises the holes 75, insertions of the pressing fixtures are not shielded by the plate body 71.

Please refer to FIGS. 2 and 4. In this embodiment, the electrical receptacle connector 100 further comprises a plurality of conductive sheets. The conductive sheets are metal elongated plates and may comprise an upper conductive sheet and a lower conductive sheet. The upper conductive sheet is assembled on the upper portion of the base portion 21, and the lower conductive sheet is assembled on the lower portion of the base portion 21. When an electrical plug connector is mated with the electrical receptacle connector 100, the front of a metallic shell of the electrical plug connector is in contact with the conductive sheets, the metallic shell of the electrical plug connector is efficiently in contact with the metallic shell 11 of the electrical receptacle connector 100 via the conductive sheets, and the electromagnetic interference problem can be improved.

Figure 11:
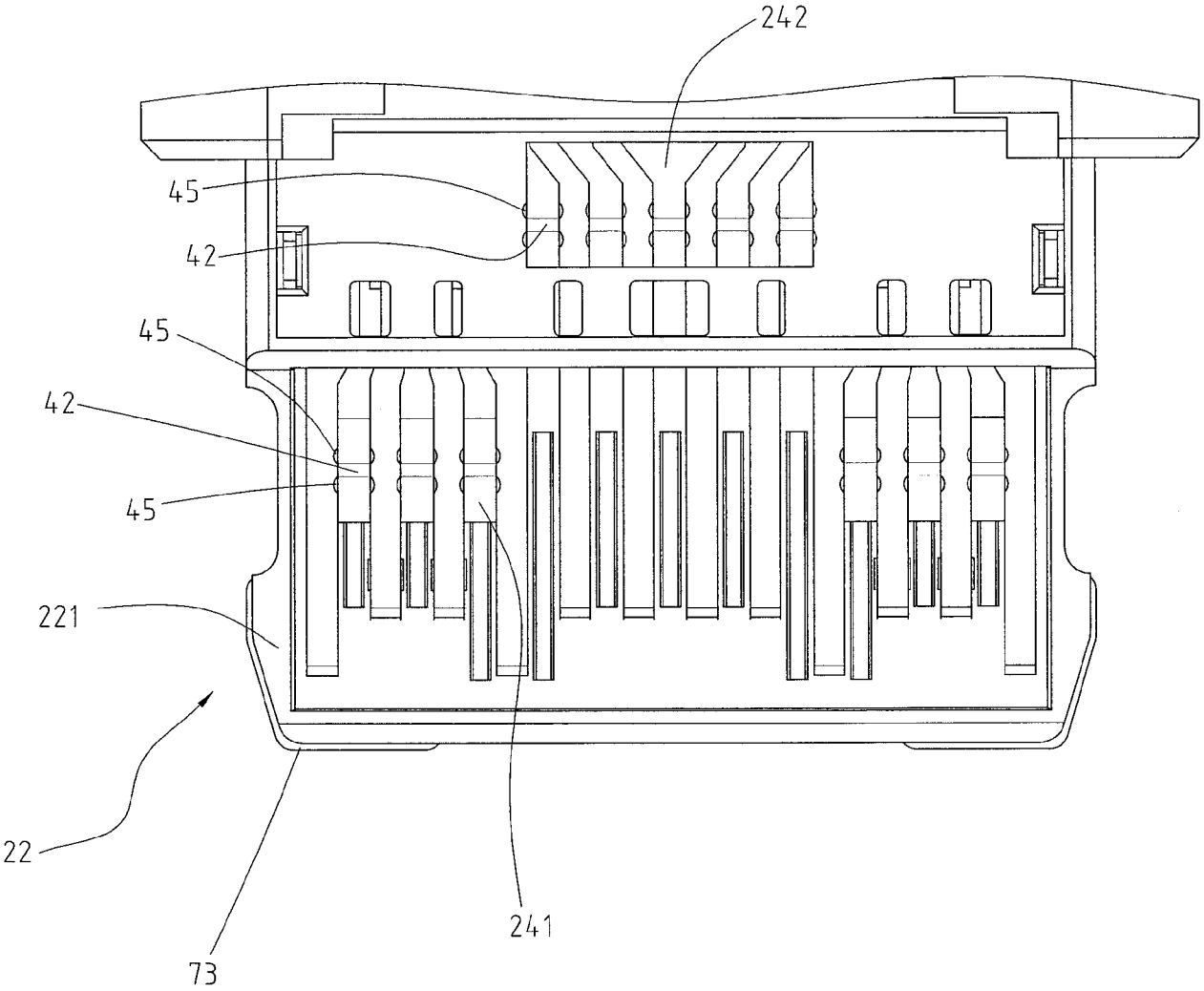
FIG. 11 illustrates a top view of the electrical receptacle connector of the second embodiment with first through holes, a second through hole, and the extending portions.
Figure 12:
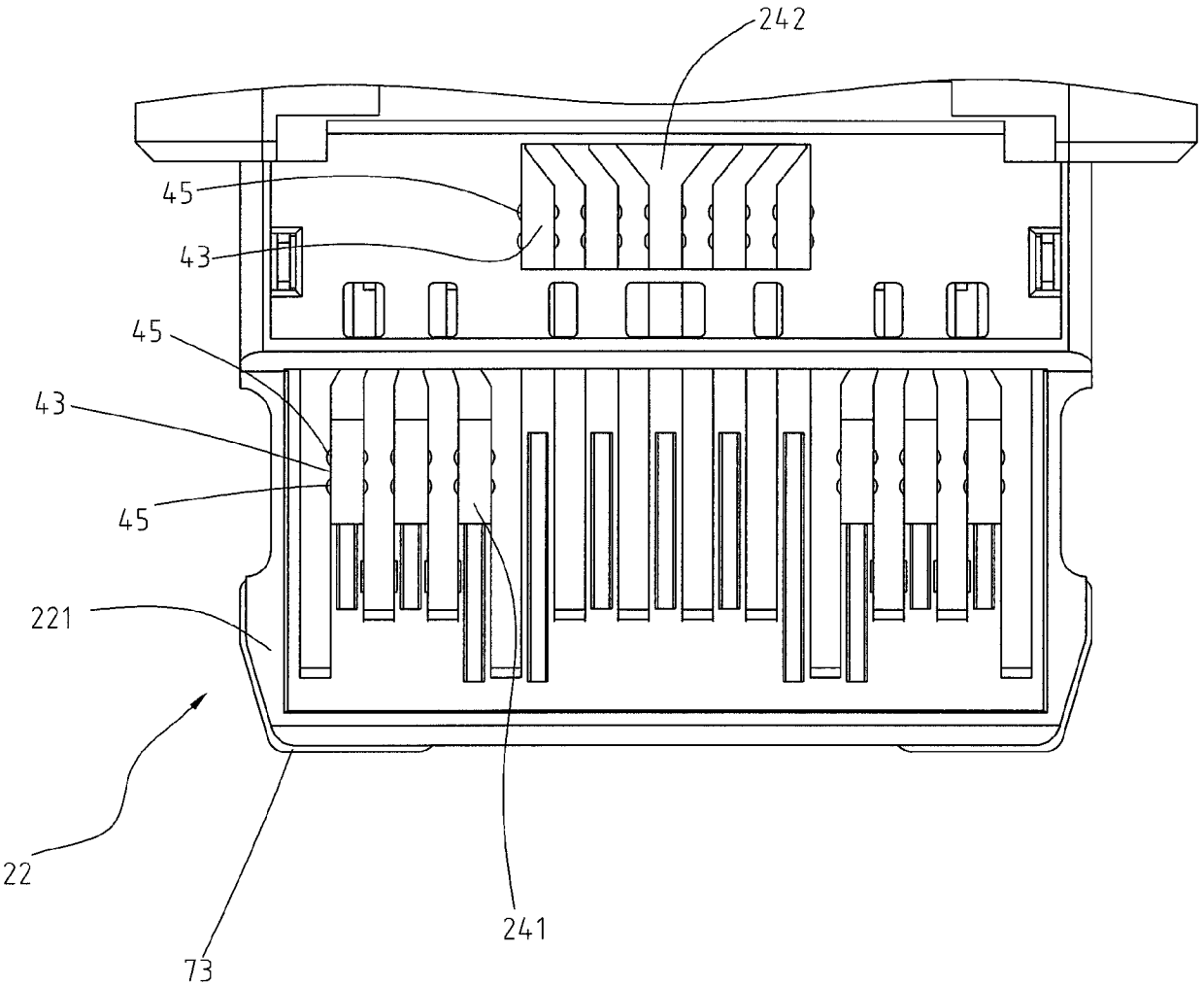
FIG. 12 illustrates a top view of the electrical receptacle connector of the second embodiment with the first through holes, the second through hole, and the cut portions.

Please refer to FIGS. 10 to 12, illustrating an electrical receptacle connector 100 according to a second embodiment of the instant disclosure. In the second embodiment, during the second receptacle terminals 41 are insert-molded with the second portion 252, the shifting problem of the second low-speed signal terminals 4112 can be improved. Conversely, in the first embodiment, additional assisting fixtures are provided for positioning the second low-speed signal terminals 4112 in the mold, so that the second low-speed signal terminals 4112 are not shifted when the second low-speed signal terminals 4112 are integrated with the second portion 252.

Please refer to FIGS. 10 to 12. In the second embodiment, the insulated housing 2 further comprises a second through hole 242 formed at a middle portion of the rear of the tongue portion 22. In other words, the second through hole 242 is formed at a middle portion of the rear of the tongue portion 22 of the second portion 252 and adjacent to the base portion 21, but embodiments are not limited thereto. Alternatively, the second through hole 242 may be formed at a middle portion of the front of the tongue portion 22. The structure and the function of the second through hole 242 are similar to that of the first through hole 241. In addition, the body portions 417 of the pair of the second low-speed signal terminals 4112 correspond to the second through hole 242 at the middle portion of the rear of the tongue portion 22. In addition, the pair of the second low-speed signal terminals 4112 and their left supplement terminal 4142 are integrated with each other by the extending portions 42, and the pair of the second low-speed signal terminals 4112 and their right second function detection terminal 4141 are integrated with each other by the extending portions 42. In other words, the extending portions 42 correspond to the second through hole 242.

Please refer to FIGS. 10 to 12. In the second embodiment, in a first time insert-molded procedure, the pair of the second low-speed signal terminals 4112, the supplement terminal 4142, and the second function detection terminal 4141 are properly positioned and integrated with the second portion 252. Then, in a second time insert-molded procedure, the filling members 5 are formed in the second through hole 242 at the middle portion of the rear of the tongue portion 22, so that the filling members 5 cover the body portions 417 of the pair of the second low-speed signal terminals 4112, the body portion 417 of the supplement terminal 4142, and the body portion 417 of the second function detection terminal 4141. As a result, the filling members 5 are filled in the second through hole 242 to separate each pair of the first high-speed signal terminals 3111/3113 from the corresponding pair of the second high-speed signal terminals 4111/4113.

Figure 14:
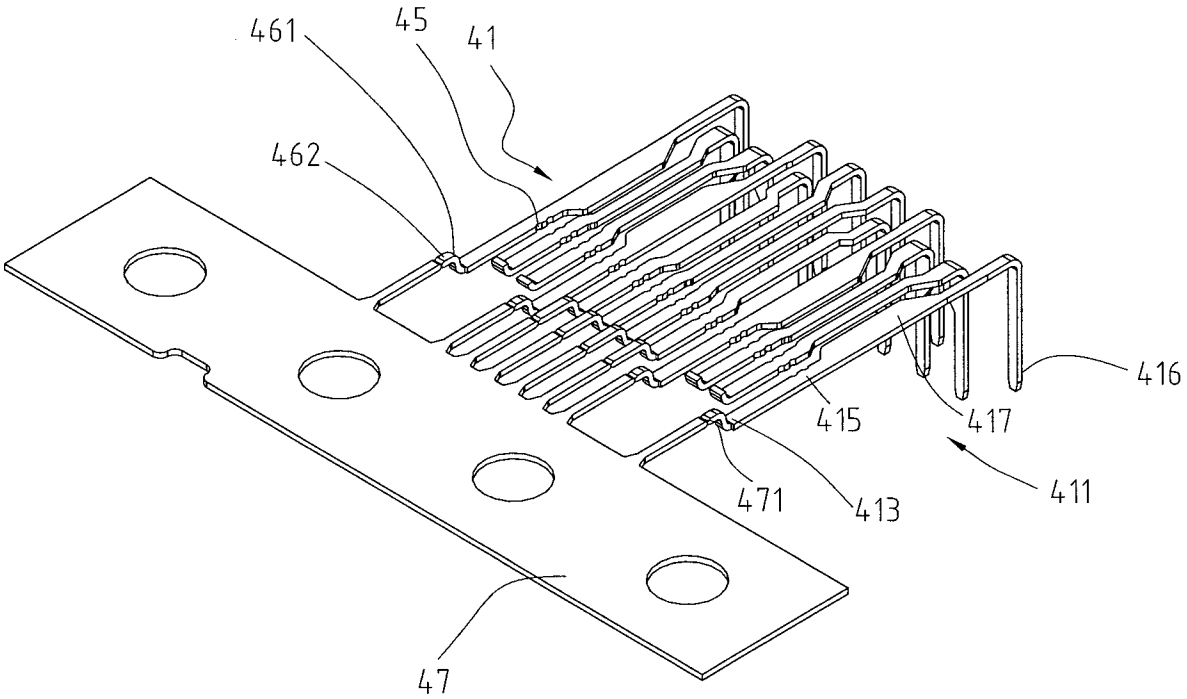
FIG. 14 illustrates a perspective view of second receptacle terminals of an electrical receptacle connector according to a third embodiment of the instant disclosure.
Figure 15:
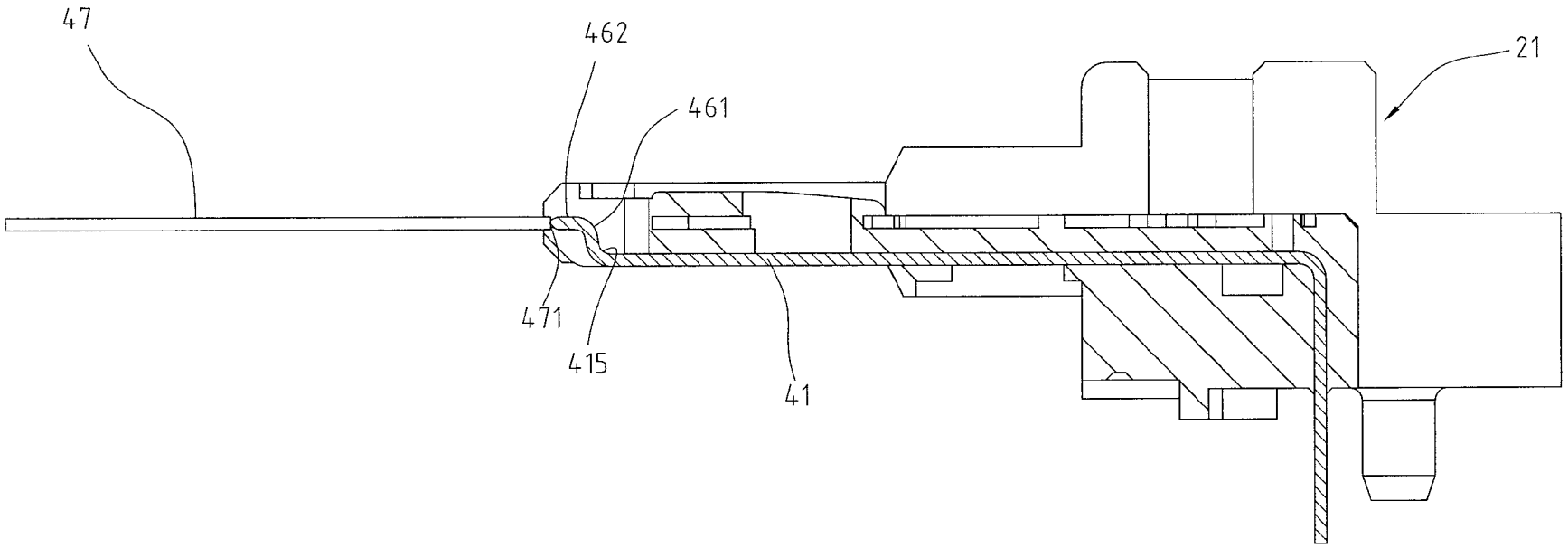
FIG. 15 illustrates a lateral sectional view of the electrical receptacle connector of the third embodiment.
Figure 16:
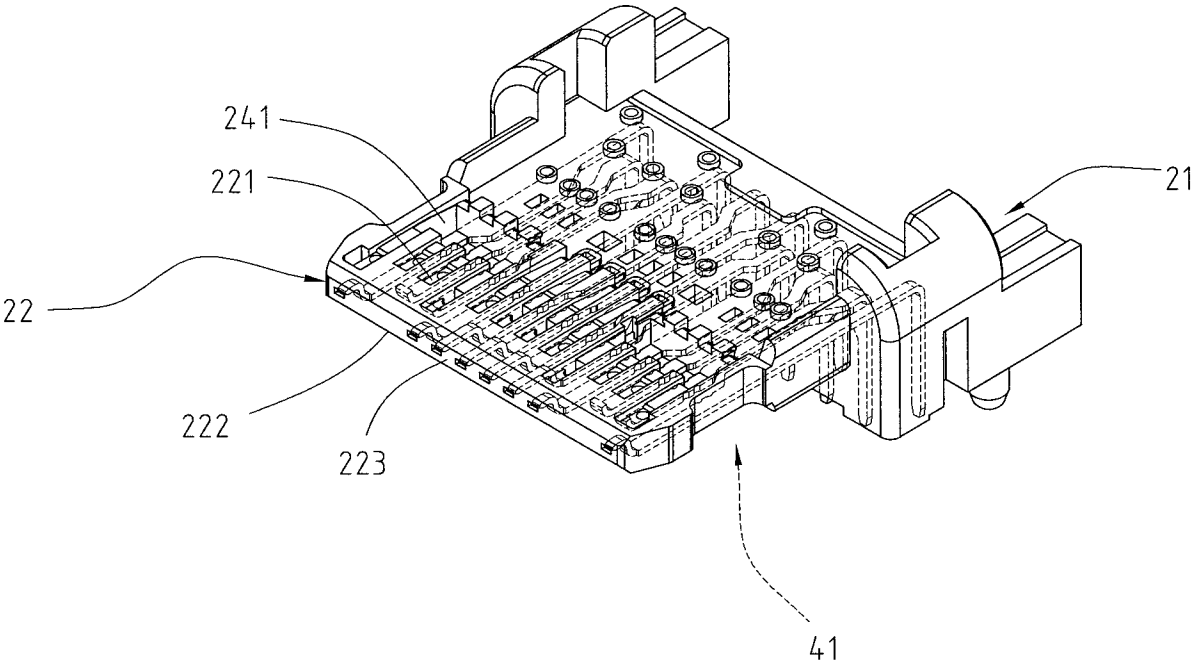
FIG. 16 illustrates a perspective view of the electrical receptacle connector of the third embodiment.

Please refer to FIGS. 14 to 16, illustrating an electrical receptacle connector 100 according to a third embodiment of the instant disclosure. In the third embodiment, during the second receptacle terminals 41 are insert-molded with the second portion 252, the shifting problem of the second low-speed signal terminals 4112 can be improved. While the structure of the third embodiment is different from that of the second embodiment, in the third embodiment, the shifting problem of the second low-speed signal terminals 4112 can be improved as well.

Please refer to FIGS. 14 to 16. In the third embodiment, each of the second receptacle terminals 41 further comprises a turning portion 461 and a lengthened portion 462. The turning portion 461 is extending upward from the front of the flat contact portion 415 and bending toward the tongue portion 22. The lengthened portion 462 is extending from the top of the turning portion 461 and extending toward the front lateral surface 223 of the tongue portion 22. The electrical receptacle connector 100 further comprises a strip or belting 47 connecting to the second receptacle terminals 41. The second receptacle terminals 41 and the strip or belting 47 are integrated with each other as a whole. In other words, the lengthened portions 462 are extending to the strip or belting 47, and the lengthened portions 462 are integrated with the strip or belting 47.

Please refer to FIG. 2 and FIGS. 14 to 16. In this embodiment, the turning portion 461 and the lengthened portion 462 may be extending from the flat contact portion 415 of each of the second low-speed signal terminals 4112, from the flat contact portion 415 of the supplement terminal 4142 at the left side of the second low-speed signal terminals 4112, and from the flat contact portion 415 of the second function detection terminal 4141 at the right side of the second low-speed signal terminals 4112.

For the third embodiment, in the first insert-molding procedure, the lengthened portions 462 are extending and integrating with the strip or belting 47, so that the second low-speed signal terminals 4112, the supplement terminal 4142, and the second function detection terminal 4141 would not be shifted freely and can be assembled with the second portion 252 properly. Consequently, during the insert-molding procedure, the second low-speed signal terminals 4112, the supplement terminal 4142, and the second function detection terminal 4141 would not be pushed by the plastic material for molding the insulated housing 2. Next, breaking portions 471 between the strip or belting 47 and the lengthened portions 462 are broken, and a semi-product of the assembly of the second portion 252 and the second receptacle terminals 41 can be manufactured.

In some embodiments, the turning portion 461 and the lengthened portion 462 may be extending from the flat contact portion 415 of the power terminal 412 adjacent to each pair of the second high-speed signal terminals 4111/4113 and from the flat contact portion 415 of the ground terminal 413 adjacent to each pair of the second high-speed signal terminals 4111/4113, while the second high-speed signal terminals 4111/4113 do not have the turning portion 461 and the lengthened portion 462. In other words, except the second high-speed signal terminals 4111/4113, each of the second receptacle terminals 41 (i.e., the ground terminals 413, the power terminals 412, the second function detection terminal 4141, the second low-speed signal terminals 4112, and the supplement terminal 4142) further comprises the turning portion 461 and the lengthened portion 462. The lengthened portions 462 of the second receptacle terminals 41 are further integrated with the strip or belting 47, so that the second receptacle terminals 41 would not be shifted freely and can be assembled with the second portion 252 properly during the manufacturing procedure. In addition, because the second receptacle terminals 41 may be further integrated and connected with each other via the extending portions 42 as described in the first embodiment, the second receptacle terminals 41 would not be shifted freely and can be assembled with the second portion 252 properly during the manufacturing procedure.

Based on the above, the first through holes formed on the tongue portion correspond to the extending portions between the second high-speed signal terminals, the power terminals, and the ground terminals of the second receptacle terminals. Pressing fixtures can be inserted into the first through holes to cut away the extending portions and form and remain the cut portions (i.e. cut surfaces). The extending portions between the second high-speed signal terminals, the power terminals, and the ground terminals of the second receptacle terminals allows the second receptacle terminals to be positioned so as to be assembled with the second portion properly. Accordingly, each pair of the first high-speed signal terminals is spaced from the corresponding pair of the second high-speed signal terminals by a uniform interval, and the signal interference problem between the first high-speed signal terminals and the second high-speed signal terminals can be prevented and improved. Hence, problems found in the conventional can be improved.

In addition, the manufacturing of the assembly of the insulated housing and the receptacle terminals has two times of insert-molding procedures, in a first time insert-molded procedure, the first receptacle terminals are integrated with the first portion, and the second receptacle terminals are integrated with the second portion. Next, in a second time insert-molded procedure, the filling members are formed in the first through holes to cover the body portion of each of the second high-speed signal terminals, the body portion of each of the power terminals, and the body portion of each of the ground terminals. The filling members are filled in the first through holes to separate each pair of the first high-speed signal terminals from the corresponding pair of the second high-speed signal terminals. As a result, the first high-speed signal terminals and the second high-speed signal terminals can be positioned properly. In addition, the filling members improves the structural strength of the tongue portion, and the filling members prevent the power terminals and the ground terminals exposed out of the first through holes from being connected electrically with each other. It is understood that when water moist is attached to the surfaces of the second receptacle terminals, short circuit problem may occur; in other words, the filling members can reduce the possibility of the short circuit problem.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180 degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a metallic shell, comprising a shell body and a receiving cavity defined therein;

an insulated housing received in the receiving cavity, wherein the insulated housing comprises a base portion, a tongue portion, and a plurality of first through holes, the tongue portion is extending from one side of the base portion, the first through holes are formed on the tongue portion, the tongue portion has a first surface and a second surface, and the first surface is opposite to the second surface;

a plurality of first receptacle terminals comprising a plurality of first signal terminals, a plurality of power terminals, and a plurality of ground terminals, wherein each of the first receptacle terminals is held in the insulated housing and disposed at the first surface, wherein each of the first receptacle terminals comprises a flat contact portion, a body portion, and a tail portion, wherein the body portion is held in the base portion and disposed at the first surface of the tongue portion, the flat contact portion is extending forward from the body portion in the rear-to-front direction and partly exposed upon the first surface of the tongue portion, the tail portion is extending backward from the body portion in the front-to-rear direction and extending out of the base portion, and wherein the first signal terminals comprise a plurality of pairs of first high-speed signal terminals, each pair of the first high-speed signal terminals is between the corresponding power terminal and the adjacent ground terminal; and a plurality of second receptacle terminals comprising a plurality of second signal terminals, a plurality of power terminals, and a plurality of ground terminals, wherein each of the second receptacle terminals is held in the insulated housing and disposed at the second surface, wherein each of the second receptacle terminals comprises a flat contact portion, a body portion, a tail portion, at least one cut portion, wherein the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, and wherein the second signal terminals comprise a plurality of pairs of second high-speed signal terminals and a pair of low-speed signal terminals, each pair of the second high-speed signal terminals is between the corresponding power terminal and the adjacent ground terminal, and the pair of the low-speed signal terminals is between the second high-speed signal terminals, each pair of the second high-speed signal terminals is adjacent to the corresponding pair of the first high-speed signal terminals, the cut portions are formed at the side portion of the flat contact portion of each of the second high-speed signal terminals, the side portion of the flat contact portion of each of the power terminals, and the side portion of the flat contact portion of each of the ground terminals, and the cut portions respectively correspond to the first through hole, a plurality of extending portions are formed and extending between the side portions of the flat contact portion of the second high-speed signal terminals, one side portion of the flat contact portion of each power terminal, and one side portion of the flat contact portion of each ground terminal, wherein the extending portions are cut away to remain the cut portions.

2. The electrical receptacle connector according to claim 1, further comprising a plurality of filling members, wherein the filling members are filled in the first through holes to cover the side portions of the flat contact portion of the second high-speed signal terminals, the one side portion of the flat contact portion of each power terminal of the second receptacle terminal, and the one side portion of the flat contact portion of each ground terminal of the second receptacle terminal.

3. The electrical receptacle connector according to claim 1, wherein the width of each of the first through holes equals to the distance between each of the power terminals of the second receptacle terminal and the adjacent ground terminal of the second receptacle terminal.

4. The electrical receptacle connector according to claim 1, wherein each of the first through holes is defined through the tongue portion, from the first surface to the second surface.

5. The electrical receptacle connector according to claim 1, wherein the first through holes are formed at two sides of the front of the tongue portion, the first through holes correspond to the flat contact portion of each of the second high-speed signal terminals, the flat contact portion of each of the power terminals of the second receptacle terminal, and the flat contact portion of each of the ground terminals of the second receptacle terminal.

6. The electrical receptacle connector according to claim 1, wherein the insulated housing further comprises a second through hole formed at a middle portion of the rear of the tongue portion, wherein the body portion of each of the low-speed signal terminals correspond to the second through hole.

7. The electrical receptacle connector according to claim 1, wherein except the second high-speed signal terminals, each of the second receptacle terminals further comprises a turning portion and a lengthened portion, the turning portion is extending upward from the front of the flat contact portion and bending toward the tongue portion, and lengthened portion is extending from the top of the turning portion toward a front lateral surface of the tongue portion.

8. The electrical receptacle connector according to claim 1, wherein the second receptacle terminals further comprise a plurality of cutting holes, the cutting holes are formed on the side portion of the flat contact portion of each of the second high-speed signal terminals, the side portion of the flat contact portion of each of the power terminals, and the side portion of the flat contact portion of each of the ground terminals, and the cutting holes are adjacent to each of the extending portions.

9. The electrical receptacle connector according to claim 1, further comprising a grounding plate at the insulated housing, wherein the grounding plate comprises a plate body, a plurality of hooks, and a plurality of holes, the plate body is between the flat contact portions of the first receptacle terminals and the flat contact portions of the second receptacle terminals, the hooks are extending from two sides of the front of the plate body and protruding out of a front lateral surface and two sides of the tongue portion, the holes are formed on the plate body and correspond to the first through holes.

10. The electrical receptacle connector according to claim 1, wherein the first receptacle terminals and the second receptacle terminals have 180 degree symmetrical design with respect to a central point of the receiving cavity as the symmetrical center.

11. The electrical receptacle connector according to claim 1, wherein the position of the flat contact portions of the first receptacle terminals corresponds to the position of the flat contact portions of the second receptacle terminals.

12. An electrical receptacle connector, comprising:

a metallic shell comprising a shell body and a receiving cavity defined therein;

an insulated housing received in the receiving cavity, wherein the insulated housing comprises a base portion and a tongue portion, the tongue portion is extending from the base portion, a plurality of first through holes are formed on the tongue portion, the tongue portion has a first surface and a second surface, and the first surface is opposite to the second surface;

a plurality of first receptacle terminals held in the insulated housing and disposed at the first surface, wherein each of the first receptacle terminals comprises a flat contact portion, a body portion, and a tail portion, the body portion is held in the base portion and disposed at the first surface of the tongue portion, the flat contact portion is extending forward from the body portion in the rear-to-front direction and partly exposed upon the first surface of the tongue portion, and the tail portion is extending backward from the body portion in the front-to-rear direction and extending out of the base portion; and a plurality of second receptacle terminals held in the insulated housing and disposed at the second surface, wherein each of the second receptacle terminals comprises a flat contact portion, a body portion, a tail portion, and at least one cut portion, the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, the second signal terminals comprise a plurality of pairs of second high-speed signal terminals and a pair of low-speed signal terminals, each pair of the second high-speed signal terminals is between the adjacent power terminal and the adjacent ground terminal, and the pair of the low-speed signal terminals is between the second high-speed signal terminals, the cut portions are formed at the side portions of the flat contact portions of the second high-speed signal terminals, one side portion of the flat contact portion of each power terminal, and one side portion of the flat contact portion of each ground terminal, the cut portions are respectively exposed to the first through holes, a plurality of extending portions are formed and extending between the side portions of the flat contact portions of the second high-speed signal terminals, the one side portion of the flat contact portion of each power terminal, and the one side portion of the flat contact portion of each ground terminal, wherein extending portions are cut away to remain the cut portions.

13. The electrical receptacle connector according to claim 12, further comprising a plurality of filling members, wherein the filling members are filled in the first through holes to cover the side portions of the flat contact portion of the second high-speed signal terminals, the one side portion of the flat contact portion of each the power terminal of the second receptacle terminal, and the one side portion of the flat contact portion of each ground terminal of the second receptacle terminal.

14. The electrical receptacle connector according to claim 12, wherein the insulated housing further comprises a second through hole formed at a middle portion of the rear of the tongue portion, wherein the partial body portion of each of the low-speed signal terminals exposes to the second through hole.

15. The electrical receptacle connector according to claim 12, wherein except the second high-speed signal terminals, each of the second receptacle terminals further comprises a turning portion and a lengthened portion, the turning portion is extending upward from the front of the flat contact portion and bending toward the tongue portion, and lengthened portion is extending from the top of the turning portion toward a front lateral surface of the tongue portion.

16. The electrical receptacle connector according to claim 12, further comprising a grounding plate at the insulated housing, wherein the grounding plate comprises a plate body and a plurality of holes, the plate body is between the flat contact portions of the first receptacle terminals and the flat contact portions of the second receptacle terminals, and the holes are formed on the plate body and correspond to the first through holes.

17. The electrical receptacle connector according to claim 16, wherein the grounding plate further comprises a plurality of hooks and the hooks are extending from two sides of the front of the plate body and protruding out of a front lateral surface and two sides of the tongue portion.

18. An electrical receptacle connector, comprising:

a metallic shell comprising a shell body and a receiving cavity defined therein;

an insulated housing received in the receiving cavity, wherein the insulated housing comprises a base portion and a tongue portion, the tongue portion is extending from the base portion, a plurality of first through holes are formed on the tongue portion, the tongue portion has a first surface and a second surface, and the first surface is opposite to the second surface;

a plurality of first receptacle terminals held in the insulated housing and disposed at the first surface, wherein each of the first receptacle terminals comprises a flat contact portion, a body portion, and a tail portion, the body portion is held in the base portion and disposed at the first surface of the tongue portion, the flat contact portion is extending forward from the body portion in the rear-to-front direction and partly exposed upon the first surface of the tongue portion, and the tail portion is extending backward from the body portion in the front-to-rear direction and extending out of the base portion; and a plurality of second receptacle terminals held in the insulated housing and disposed at the second surface, wherein each of the second receptacle terminals comprises a flat contact portion, a body portion, a tail portion, and at least one cut surface, the body portion is held in the base portion and disposed at the second surface of the tongue portion, the flat contact portion is extending forward from the body portion in the rear-to-front direction and partly exposed upon the second surface of the tongue portion, the tail portion is extending backward from the body portion in the front-to-rear direction and extending out of the base portion, the cut surfaces are respectively exposed to the first through holes, the cut surfaces are formed at the side portions of the flat contact portions of partial second receptacle terminals and a plurality of extending portions are formed and extending between the side portions of the flat contact portions of partial second receptacle terminals, wherein the extending portions are cut away to remain the cut surfaces.

19. The electrical receptacle connector according to claim 18, wherein the second signal terminals comprise a plurality of pairs of second high-speed signal terminals and a pair of low-speed signal terminals, each pair of the second high-speed signal terminals is between the adjacent power terminal and the adjacent ground terminal, and the pair of the low-speed signal terminals is between the second high-speed signal terminals, the cut surfaces are formed at the side portions of the flat contact portions of the second high-speed signal terminals, one side portion of the flat contact portion of each power terminal, and one side portion of the flat contact portion of each ground terminal, and the extending portions are formed and extending between the side portions of the flat contact portions of the second high-speed signal terminals, the one side portion of the flat contact portion of each power terminal, and the one side portion of the flat contact portion of each ground terminal.

* * * * *